US006207951B1

(12) United States Patent
Yamauchi et al.

(10) Patent No.: US 6,207,951 B1
(45) Date of Patent: Mar. 27, 2001

(54) METHOD OF GENERATING A PULSED METASTABLE ATOM BEAM AND PULSED ULTRAVIOLET RADIATION AND AN APPARATUS THEREFOR

(75) Inventors: Yasushi Yamauchi; Mitsunori Kurahashi; Naoki Kishimoto, all of Tsukuba (JP)

(73) Assignee: National Research Institute for Metals, Ibaraki (JP)

( * ) Notice: Subject to any disclaimer, the term of this patent is extended or adjusted under 35 U.S.C. 154(b) by 0 days.

(21) Appl. No.: 09/161,718

(22) Filed: Sep. 29, 1998

(30) Foreign Application Priority Data

Jan. 30, 1998 (JP) ..... 10-019922

(51) Int. Cl.[7] ..... H05H 3/00
(52) U.S. Cl. ..... 250/251; 250/423 F; 250/493.1
(58) Field of Search ..... 250/251, 423 F, 250/423 R, 452.21, 282, 493.1

(56) References Cited

U.S. PATENT DOCUMENTS 4,845,367 * 7/1989 Amirav et al. ..... 250/281
5,070,240 * 12/1991 Lee ..... 250/286
5,440,124 * 8/1995 Kelly et al. ..... 250/423 F
5,587,586 * 12/1996 Kruit ..... 250/423 F
5,821,548 * 10/1998 Hinchiffe ..... 250/492.21

* cited by examiner

*Primary Examiner*—Bruce C. Anderson
(74) *Attorney, Agent, or Firm*—Wenderoth, Lind & Ponack, L.L.P.

(57) ABSTRACT

A pulse discharge is caused between an electrode in an insulating nozzle 2 jetting a gas in vacuum and a skimmer 8. An apparatus for performing the method includes an insulating nozzle 2 perforated with a gas jet hole 2*a* at a front end thereof and having a needle-like electrode 5 at an inside thereof, and includes a skimmer 8 formed in a funnel-like shape and having an opening portion 8*a* at a front end thereof. The opening 8*a* is arranged at a position remote from the gas jet hole 2*a* of the insulating nozzle 2 by a predetermined distance. The method and apparatus can be used in the field of measurement, material synthesis and the like with an object of surface science, and can form simultaneously and with high intensity both pulsed metastable atom beam and pulsed ultraviolet radiation which can be preferably used as a probe for investigating the electronic state at a surface of a substance and several layers on the inner side of the surface. It can also preferably be used for removing contamination or for depositing materials on the surface of a substrate by surface chemical reaction.

15 Claims, 3 Drawing Sheets

METHOD OF GENERATING A PULSED METASTABLE ATOM BEAM AND PULSED ULTRAVIOLET RADIATION AND AN APPARATUS THEREFOR

FIELD OF THE INVENTION

The present invention relates to a method of generating a pulsed metastable atom beam and ultraviolet radiation at high frequency and a device therefor. More particularly, the present invention is an invention in the field of measurement, synthesis of material synthesis and the like with an object of surface science. The present invention relates to, for example, a method and a device for generating a high intensity pulsed metastable atom beam and pulsed ultraviolet radiation which can be preferably used as a probe for investigating an electron state at the surface of a substance and several layers on the inner side of the surface, or can be preferably used for removing contamination on the surface of a substrate or for depositing materials on a substrate by surface chemical reaction.

BACKGROUND OF THE INVENTION

When a metastable atom impinges on the surface of a substance, an electron is ejected by obtaining energy released when the atom transits from an excited state to a ground state. By analyzing the energy of the electron, the surface electronic state of the substance can be analyzed. Further, information obtained by the electron which is ejected by the metastable atom beam indicates an electronic state on the outermost layer of the surface of the substance. Accordingly, the metastable atom beam can be used as a potential measuring means or the like. Further, the electron which is ejected from the surface of the substance by irradiating ultraviolet radiation is utilized for, for example, ultraviolet photoelectron spectroscopy since the average information of a substance up to a certain depth from the surface of a substance is obtained.

The inventors of the present invention have already obtained a pulse beam by developing a source of an He metastable atom beam of an electron impact type, and have also confirmed that a continuous beam with high intensity is obtained by a source of an He metastable atom beam of a discharge type (refer to "Proceedings of 44-th Applied Physics Plenary Session (1997) 426"). When an He metastable atom beam is formed by electron impact or discharge, both continuous the He metastable atom beam and ultraviolet radiation are simultaneously formed. Therefore, in order to measure the state of the surface of a substance by using the continuous beam, it is necessary to make the beam into pulses by a mechanical chopper and to discriminate the metastable atom beam from ultraviolet radiation by combining the time-of-flight method (TOF).

For example, He gas is jetted from a nozzle of about 0.1 mm in a supersonic condition. Immediately thereafter, all of the gas except a central portion thereof having high intensity is removed by a structure in a funnel-like shape having an opening portion of about 1 mm at its front end which is referred to as skimmer, and voltage of about 300 V is applied between the nozzle and the skimmer. Then a continuous metastable atom beam and ultraviolet radiation can simultaneously be formed by continuous discharge with a discharge current of about 10 mA. However, in order to obtain a pulsed metastable atom beam or pulsed ultraviolet radiation, it is necessary to integrate a mechanical chopper.

According to the structure for generating a pulse beam by using such a mechanical chopper, although the structure of the source of the He metastable atom beam per se is simple, the structure becomes complicated and large as a whole by adding the mechanical chopper. Furthermore, a distance from the source of the He metastable atom beam to the surface of a substance becomes greater, causing the intensity of the He metastable atom beam on the surface of a substance to be weakened.

Thereby, the advantage of a source of an He metastable atom beam with a simple structure is lost. Further, when the intensity of the He metastable atom beam is increased by increasing the discharge current, the discharge current has an upper limit since there is a limit to the thermal strength of the source of the He metastable atom beam. Although it is preferable when the source of the He metastable atom beam can be driven in pulses, according to the discharge characteristics, discharge start voltage is considerably higher than the maintaining voltage. Accordingly, pulse drive becomes difficult In order to measure the quantum effect with high accuracy by a metastable atom beam probe, an atom beam with high intensity is indispensable. In order to finely measure an effect caused only by a metastable atom beam, the generation of a pulsed atom beam is necessary. However, it is the actual situation that a pulsed metastable atom beam or a pulsed ultraviolet radiation which are sufficiently satisfiable have not yet been provided.

SUMMARY OF THE INVENTION

In view of the above-described actual situation, the present invention has been developed as a result of intensive study. Its main object is to provide an apparatus for and a method of providing a pulsed metastable atom beam and pulsed ultraviolet radiation with high intensity and with no need for an additional device such as a mechanical chopper or the like.

BRIEF DESCRIPTION OF THE INVENTION

The foregoing and other objects, features and advantages of the present invention will be better understood from the following detailed description, taken in conjunction with the accompanying drawings, in which.

DETAILED DESCRIPTION OF THE INVENTION

Figure 1:
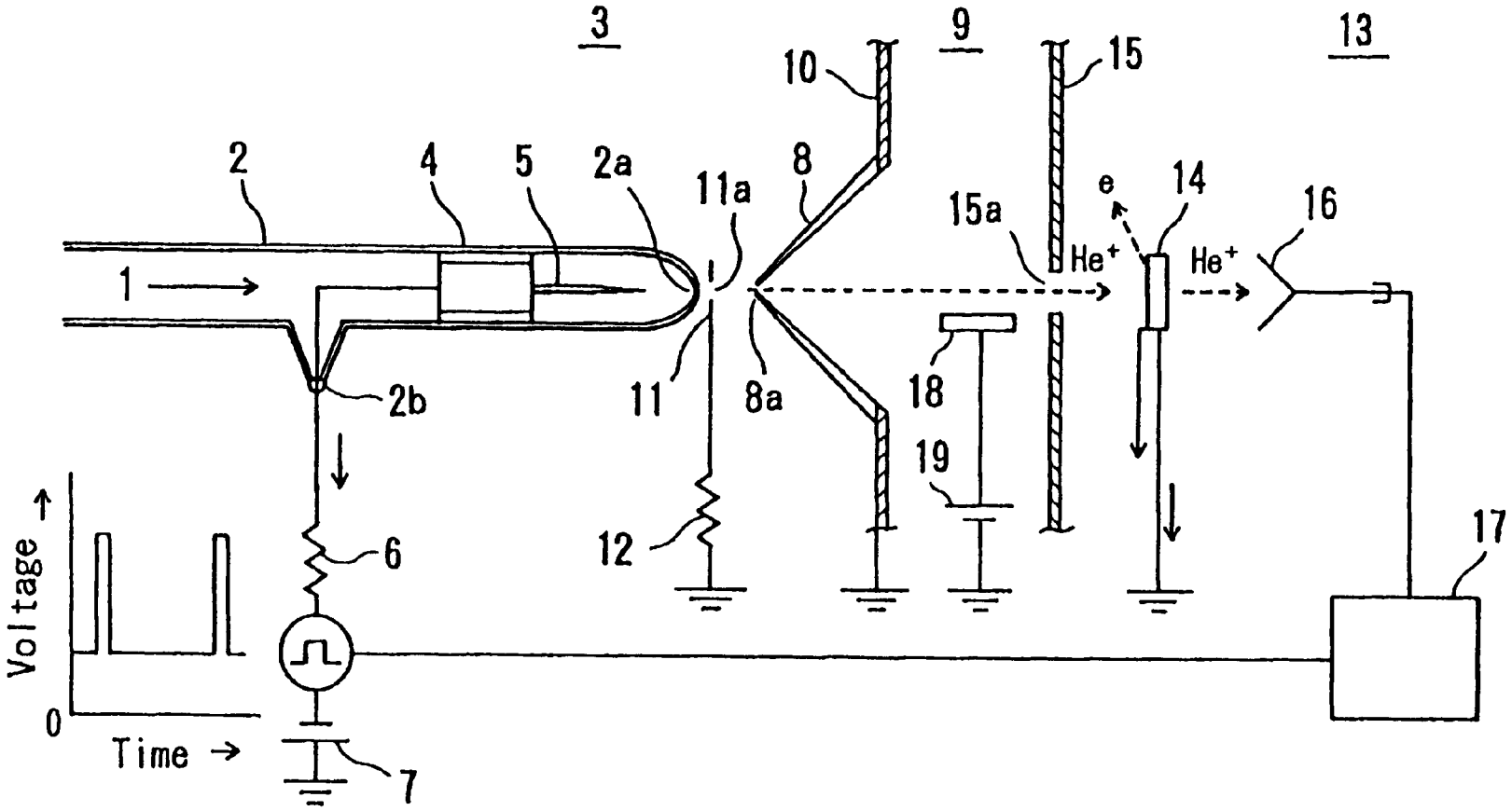
FIG. 1 is a schematic illustration showing a device for generating a pulsed metastable atom beam and ultraviolet radiation according to the present invention.

According to the present invention, when repeated pulse discharge is caused between an electrode in an insulating nozzle and a skimmer while jetting gas from the insulating nozzle at supersonic speed in a vacuum, an atom jetted from the insulating nozzle is excited by the pulse discharge. Therefore, a pulsed metastable atom beam and pulsed ultraviolet radiation are generated simultaneously.

Then, the generated pulsed metastable atom beam and ultraviolet radiation, for example, pass through an opening portion of the skimmer having a funnel-like shape and having an opening portion of about 1 mm at its front end. A beam is formed by removing the pulsed metastable atom beam at other than the opening portion, and the beam is irradiated on the surface of a substance.

Thereby, by generation of a pulsed discharge, not only is there an advantage in that a mechanical chopper is dispensed with and the structure is simplified, but also the distance between an atom source and a sample can be shortened. Thus, a great intensity of the pulsed metastable atom beam and the ultraviolet radiation on the surface of a substance can be obtained. Furthermore, for example, by irradiating the generated pulsed metastable atom beam or ultraviolet radiation onto the surface of a substance disposed in a vacuum, the device can be used in measuring the electron state on the surface. Also, by irradiating ultraviolet radiation similarly onto the surface of a substance, the device can be utilized in measuring the electron state of several layers on the inner side of the surface. In addition, by using the pulsed metasable atom beam and/or ultraviolet radiation in a surface chemical reaction, the device can be used in removing contamination from the surface of a substance for depositing materials on the surface.

Explaining the details with respect to embodiments as follows, glass of Pyrex or the like can be adopted for the above-described insulating nozzle. An aperture of a gas jet hole at a front end of the insulating nozzle is generally set at 0.1 through 1.0 mm, and more preferably, at 0.2 through 0.5 mm. The size of the aperture is determined for obtaining optimal gas pressure in the nozzle and pressure in an atom source chamber.

Further, tantulm, tungsten, molybdenum or the like can be adopted for a needle-like electrode arranged at the inside of the insulating nozzle and its preferable diameter falls in a range of 0.2 through 2.0 mm, and more preferably, of 0.5 through 1.0 mm because the nozzle needs to withstand wear by discharge while promoting stability of discharge.

Although discharge can be stabilized by adjusting discharge voltage, gas pressure and, distance between electrodes, above all, it is preferable to adopt a structure in which a trigger electrode having an opening is interposed at a predetermined position between the gas jet hole of the insulating nozzle and an opening portion of the skimmer. By applying a predetermined voltage to the trigger electrode, pulse discharge between the electrode in the insulating nozzle and the skimmer is stabilized.

The diameter of an opening of the trigger electrode depends on the aperture of the gas jet hole at the front end of the insulating nozzle, the distance between the trigger electrode and the gas jet hole, the distance between the trigger electrode and the opening portion of the skimmer, and the like. Thus, the diameter is not particularly limited.

Also, pulse voltage superposed on variable direct current voltage may be applied to the electrode in the insulating nozzle.

Further, as means for stabilizing pulse discharge, other than the trigger electrode described above, for example, a power supply for a high speed and high voltage pulse constant current of about 10 kV, by which a constant current of 100 mA can repeatedly be applied during a time period of 100 microseconds with a response time of 0.1 microsecond, can be used. Still further, it seems that stabilization of pulsed discharge similar to that achieved by the trigger electrode can be achieved by adding a filament for generating a thermoelectron as used in a fluorescent lamp to the surrounding of a needle-like electrode.

In respect of the gas, rare gas is preferable, above all, He is preferable for the reason that energy in an excited state thereof is as large as 20 eV.

FIG. 1 is an schematic illustration showing an example of a device for generating a pulsed metastable atom beam and ultraviolet radiation for carrying out the method of the present invention. In the following, an explanation will be given of the device with He as an atom source.

As illustrated in FIG. 1, an insulting nozzle 2 of the present device is made of Pyrex, formed in a cylindrical shape and perforated with a gas jet hole 2*a* at the central portion of a round closed front end thereof The gas jet hole 2*a* may be perforated by, for example, ultrasonic machining. The insulating nozzle 2 is set inside of an atom source chamber 3, and the rear end of the insulating nozzle 2 is connected to an He gas supply source (not illustrated) supplying He gas 1 at a high pressure to the insulating nozzle. The inside of the atom source chamber 3 can be set to a predetermined vacuum pressure by, for example, a turbo molecular pump (not illustrated).

A circular cylinder 4 made of stainless steel capable of passing He gas 1 is installed in the insulating nozzle 2, and a needle-like electrode 5 made of tantalum is welded to the circular cylinder 4 by spot welding so that its front end is directed toward the center of the gas jet hole 2*a* of the insulating nozzle 2. The needle-like electrode 5 constitutes a cathode, and a lead-out line connected to the circular cylinder 4 made of stainless steel is drawn through a lead-out portion 2*b* installed at a side of the insulating nozzle 2 and is connected to, via a resistor 6, a negative output of a direct current power supply 7 which is operated in a constant current mode. The positive output of the direct current power supply 7 is grounded.

A skimmer 8 formed in a funnel-like shape and having an opening portion 8*a* at its front end is installed at a position separated from the insulating nozzle 2 by a predetermined distance. The skimmer 8 is attached to a vacuum wall 10 partitioning the atom source chamber 3 and a buffer chamber 9. The skimmer 8 is directly grounded without an interposing resistor.

The direct current power supply 7 can apply a predetermined constant current, can superpose a fixed voltage having a predetermined pulse width generated from a pulse power source (not illustrated) on a predetermined variable voltage by the direct current power supply 7, and can cause a pulse discharge between the electrode 5 and the skimmer 8.

A trigger electrode 11 having an opening 11*a* at a substantially central portion thereof is arranged at a position at a vicinity of the insulating nozzle between the gas jet hole 2*a* of the insulating nozzle 2 and the opening portion 8*a* of the skimmer 8. The trigger electrode 11 is grounded via a ground resistor 12.

Pulse discharge is caused between the needle-like electrode 5 and the skimmer 8 by applying a voltage produced by superposing a fixed predetermined pulse voltage on predetermined variable direct voltage on the needle-like electrode 5. Thus, both a pulsed He metastable atom beam and ultraviolet radiation are simultaneously generated. In order to realize a stable pulse discharge, the discharge voltage, gas pressure, distance between electrodes and so on, which are major parameters of the discharge, are pertinently adjusted. A stable pulse discharge can be realized easily and firmly by interposing the trigger electrode 11 between the needle-like electrode 5 and the skimmer 8 and controlling the discharge voltage. Pulse discharge current caused by pulsed discharge can be controlled by two different time constants First, it is stabilized sufficiently faster than the pulse width by the resistor 6 connected in series with the needle-like electrode 5. Second, it is also finely stabilized by the direct current power source operating in a constant current mode. The former time constant is as fast as or faster than 0.1 microsecond due to the resistor 6 (for example, 1 kΩ) and floating capacitance (for example, several 10 pF) around the circular cylinder 4 and the needle-like electrode 5. The latter time constant is as slow as or slower than one millisecond in response time of the direct current power source 7.

Further, the axis line of the needle-like electrode 5 is set to coincide with an axis line connecting the center of the gas jet hole 2*a* of the insulating nozzle 2, the center of the opening 11*a* of the trigger electrode 11 for passing gas, and the center of the opening portion 8*a* of the skimmer 8.

In FIG. 1, there is adopted a structure capable of measuring a total beam density and a TOF spectrum of an atom beam to investigate the function of an atom source. An ultra high vacuum chamber 13 is connected to the atom source chamber 3 via the buffer chamber 9 for differential pumping. Further, a sample 14 is located in the ultra high vacuum chamber 13 and a pulsed He metastable atom beam and ultraviolet radiation which have passed through a through hole 15*a* perforated at an ultra high vacuum wall 15 impinges upon the sample 14. By shifting the sample 14 from the central axis, the He atom beam and ultraviolet radiation are directly detected by a detector 16 installed on the rear side of the sample 14 and its signal can be accumulated by a multi channel scaler (MCS) 17 for a TOF spectrum in cooperation with the reference pulse of the pulse power supply. Although a secondary electron multiplier is adopted as the detector, the detector is not limited thereto. The sample 14 can always be maintained at a constant potential by being directly grounded and flowing a target current. Further, the ultra high vacuum chamber 13 can be set to a predetermined vacuum puressure by, for example, a turbo molecular pump (not illustrated).

The buffer chamber 9 can be set to a predetermined vacuum pressure by, for example, a turbo molecular pump (not illustrated), and a deflecting electrode 18 in a plate-like shape is installed in the buffer chamber 9 for removing charged particles or Rydberg atoms. The deflecting electrode 18 is maintained at a predetermined voltage by being connected to a direct current power supply 19.

In the above-described embodiment of the present invention, the insulating nozzle 2 is made of Pyrex having an outer diameter of 9 mm and is perforated with the gas jet hole 2*a* having a diameter of 0.3 mm at its front end. Further, the needle-like electrode 5 made of tantalum having a diameter of 0.8 mm is used. The distance from the gas jet hole 2*a* to the trigger electrode 11, the distance therefrom to the opening portion 8*a* of the skimmer 8, the distance therefrom to the sample 14, and the distance therefrom to the secondary electron multiplier are respectively set to 1 mm, 6 mm, 700 mm and 1100 mm. A stainless steel plate is used for the sample 14. The diameter of the opening 11*a* of the trigger electrode 11 is set to 1.3 mm. The atom source chamber 3 is evacuated by a turbo molecular pump of 1000 1/s and its vacuum pressure in operation is set to 2 through 0.2 Pa. The buffer chamber 9 is evacuated by a turbo molecular pump of 250 1/s and its vacuum pressure in operation is set to $10^{-2}$Pa. The ultra high vacuum chamber 13 is evacuated by an ion pump of 320 1/s and its vacuum pressure in operation is set to $10^{-3}$Pa. Resistance of the resistor 6 connected to the needle-like electrode 5 is set to 1 kΩ, and resistance of the ground resistor 12 is set to 200 kΩ. The needle-like electrode 5 is applied with a voltage produced by superposing a fixed voltage pulse of 900 V on a variable direct current voltage of 600 V via the resistor 6. Voltage of the deflecting electrode 18 is set to 120 V. The pulse discharge current is controlled by two different time constants. The pulse discharge current is stabilized sufficiently faster than the pulse width of 0.01 through 0.1 ms by the resistor 6, and is also finely stabilized by the direct current power supply 7 operating in a constant current mode. The discharge current is set by the direct current power supply 7 in consideration of the duty ratio of the pulse.

After being set in this way, He gas is supplied to the insulating nozzle 2, a pulse discharge is sustained between the needle-like electrode 5 and the skimmer 8, and a pulsed He metastable atom beam and ultraviolet radiation are simultaneously generated and are then counted by the MCS 17.

Figure 2:
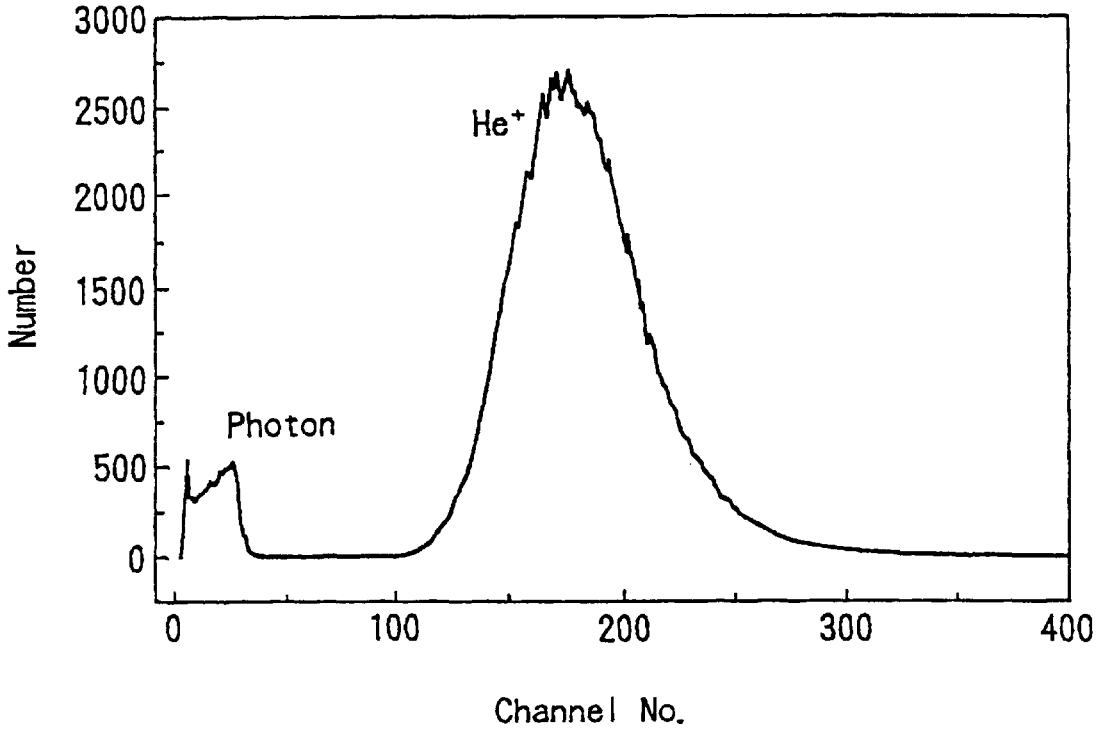
FIG. 2 is a spectrum of an time-of-flight of an He metastable atom beam and ultraviolet radiation obtained by the device shown in FIG. 1.

FIG. 2 shows a time-of-flight spectrum under a pressure of the atom source chamber 3 of 0.8 Pa and a dwell time of MSC 17 of 2 μs. A sharp peak of channel 4 through 20 in FIG. 2 is caused by ultraviolet radiation from the atom source and the shape of the peak well reflects the waveform of the pulse discharge current. A wide peak of channel 100 through 300 indicates that the peak coincides excellently with the anticipated time-of-flight of metastable He atoms. Further, a typical value of the pulse discharge current is 200 mA in respect of voltage 600 V between the nozzle and skimmer. This is larger than a discharge current of 10 mA at a voltage between the nozzle and skimmer of 300 V of a continuous discharge metastable atomic beam source of a conventional low power type by one digit.

Further, the total beam density can be determined by the current of a target when a metastable atom beam impinges on a stainless steel target of 10 mm square. That is, for example, the total beam density per unit solid angle is calculated in consideration of the fact that when a metastable He atom impinges on the stainless steel plate, electrons are emitted from the stainless steel plate at a rate of 0.7 per atom (refer to "Dunning et al, Rev. Sci. Instrum, 46 (1975) 697") and at an irradiation solid angle determined by a distance from the atom beam source to the target and the duty ratio of the pulse.

Although an atom may have several degrees of freedom of electron spin inside the atom, normally, the electron spin is directed at random. When the electron spin inside of an atom is aligned, it seems that energy distribution from the electron emitted in irradiation of a surface of a solid or the like is influenced. Thus, the spin state of the electron at the outermost surface of a solid can be known.

Hence, when an He atom excited in triplet state provided by the present invention is irradiated by a circularly polarized radiation of 1083 nm, a spin polarized metastable He atom beam can be provided. The spin polarzation can be confirmed by a so called Stern-Gerlach experiment in which different spins are discriminated by passing an atom beam through a uniformly diversing magnetic field formed by a permanent magnet and a pole piece made of soft iron.

Figure 3:
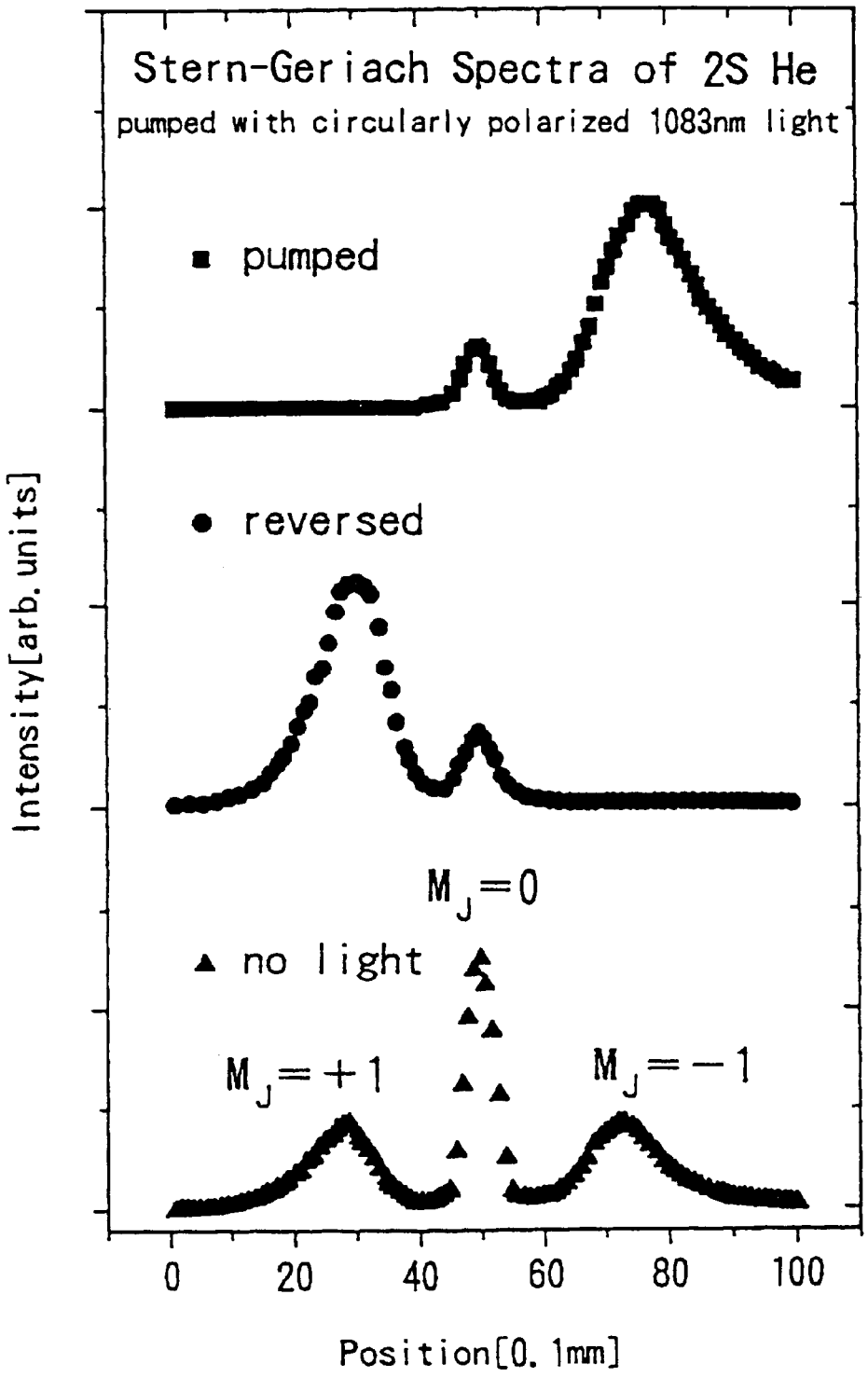
FIG. 3 is a diagram exemplifying the Stern-Gerlach Spectra.

FIG. 3 exemplifies the obtained Stern-Gerlach spectra. As shown by FIG. 3, when circularly polarized radiation pours, metastable atoms having spins +1 and 0 converted to that of spin −1, and when the direction of rotation of circularly polarized radiation is reversed, the spin of the metastable atoms are converted to totally reversed spin +1.

According to the method and the device of the present invention as described above in details, a pulsed metastable atom beam and a pulsed ultraviolet radiation can be obtained with no need for integrating a mechanical chopper. That is, the present invention is useful in the field of measurement, material synthesis or the like with an object of surface science. The present invention can simultaneously generate both an intense pulsed metastable atom beam and ultraviolet radiation which can be preferably used as, for example, a probe for investigating the electronic state at a surface of a substance or at several layers on the inner side of a surface and can also be used, for example, in removing a contaminant on the surface of a substance or for depositing materials on the surface by surface chemical reaction.

More specifically, whether an oxygen atom or the like adsorbed on the surface of a transition metal of Ti, Zr, V or the like is present above or below the surface of the atom has been continued to be studied and discussed intensively. However, by measuring the energy distribution of an electron emitted when a pulsed metastable He atom beam and ultraviolet radiation obtained by the present invention impinge on the surface of a transition metal, the electronic state of an atom on the uppermost layer of the surface and the average electronic state of an atom distributed at several layers inside of the surface can be known. Then the position of an adsorbed atom can be predicted from the difference in electronic states at such different depths.

Further, in fabricating a semiconductor device of Si or GaAs, a portion constituting a main body of the device is formed on a semiconductor single crystal substrate by a molecular beam epitaxial process. In that case, the degree of cleanliness of the surface of the substrate significantly influences the grade, which becomes an industrially important problem. A method of removing a contaminant by oxidizing it by ozone or the like has conventionally attracted attention in treatment of cleaning the surface of substrate. However, according to such prior-art method, the surface of the substrate is also oxidized. In contrast, when a pulsed metastable He atom beam and ultraviolet radiation both having high energy of 20 eV inside thereof pour on the surface of a substrate, the chemical bond between the contaminant and the surface is cut by the high energy released at the surface of substrate. Thus, the contaminant can be removed without oxidizing the surface of substrate.

The pulsed metastable atom beam and the pulsed ultraviolet radiation source formed by the method and the device of the present invention are expected to form a new market as an important and standard probe of a surface electron spectroscopy for investigating an electronic state at the outermost surface. In addition, in the semiconductor industry or the like, the present invention is expected to promote productivity of yield or the like as a cleaning means having a wide range of applications for removing contamination from the surface of a material which is reductive and damage free.

Thereby, function in surface analysis can be promoted and completeness of material synthesis at the atomic level on a surface can be improved.

While the invention has been described in detail and with reference to specific embodiments thereof, it will be apparent to one skilled in the art that various changes and modifications can be made therein without departing from the spirit and scope thereof

What is claimed is:

1. A method of generating a pulsed metastable atom beam and pulsed ultraviolet radiation, comprising:

supplying a gas to an insulating nozzle such that the gas is jetted from the insulating nozzle under a vacuum, wherein an electrode is positioned inside the insulating nozzle; and applying a pulse voltage to the electrode inside the insulating nozzle such that a pulsed metastable atom beam and pulsed ultraviolet radiation are created between the electrode inside the insulating nozzle and a skimmer positioned downstream of a gas jet hole at a front end of the insulating nozzle.

2. The method of claim 1, further comprising stabilizing the pulsed metastable atom beam and pulsed ultraviolet radiation between the electrode and the skimmer by applying a predetermined voltage to a trigger electrode positioned between the electrode in the insulating nozzle and the skimmer.

3. The method of claim 2, wherein said applying of a pulse voltage to the electrode inside the insulating nozzle comprises applying a pulse voltage superposed on a variable direct current voltage to the electrode.

4. The method of claim 2, wherein said supplying of gas to the insulating nozzle comprises supplying He gas.

5. The method of claim 1, wherein said applying of a pulse voltage to the electrode inside the insulating nozzle comprises applying a pulse voltage superposed on a variable direct current voltage to the electrode.

6. The method of claim 5, wherein said supplying of gas to the insulating nozzle comprises supplying He gas.

7. The method of claim 1, wherein said supplying of gas to the insulating nozzle comprises supplying He gas.

8. The method of claim 1, wherein the electrode positioned inside the insulating nozzle comprises a needle electrode.

9. An apparatus for generating a pulsed metastable atom beam and pulsed ultraviolet radiation, comprising:

an insulating nozzle having a front end and a gas jet hole at said front end, said insulating nozzle including an electrode at an inside portion thereof;

a gas source for supplying gas to said insulating nozzle;

a pulse voltage source for applying a pulse voltage to said electrode inside said insulating nozzle so as to create a pulsed metastable atom beam and pulsed ultraviolet radiation; and a skimmer having a funnel shape, a front end facing said front end of said insulating nozzle, and an opening at said front end of said skimmer, said opening of said skimmer being separated from said gas jet hole of said insulating nozzle by a predetermined distance.

10. The apparatus of claim 9, further comprising a trigger electrode having an opening, said trigger electrode being positioned between said gas jet hole of said insulating nozzle and said opening of said skimmer.

11. The apparatus of claim 9, wherein said electrode comprises a needle electrode.

12. The apparatus of claim 11, wherein said needle electrode is arranged in said insulating nozzle such that a longitudinal axis of said needle electrode is parallel to a longitudinal axis of said insulating nozzle.

13. The apparatus of claim 12, wherein said needle electrode is formed of tantalum.

14. The apparatus of claim 9, further comprising an atom source chamber accommodating said insulating nozzle, and further comprising a turbo molecular pump for creating a vacuum in said atom source chamber.

15. The apparatus of claim 9, wherein said predetermined distance between said gas jet hole of said insulating nozzle and said opening of said skimmer is less than 10 mm.

* * * * *